US007126477B2

(12) United States Patent
Gallivan et al.

(10) Patent No.: US 7,126,477 B2
(45) Date of Patent: Oct. 24, 2006

(54) MILLIMETER-WAVE AREA-PROTECTION SYSTEM AND METHOD

(75) Inventors: James E. Gallivan, Pomona, CA (US); Kenneth W. Brown, Yucaipa, CA (US); Philip D. Starbuck, Redlands, CA (US); Andrew K. Brown, Victorville, CA (US)

(73) Assignee: Raytheon Company, Waltham, MA (US)

( * ) Notice: Subject to any disclaimer, the term of this patent is extended or adjusted under 35 U.S.C. 154(b) by 106 days.

(21) Appl. No.: 10/758,334

(22) Filed: Jan. 15, 2004

(65) Prior Publication Data

US 2005/0156743 A1 Jul. 21, 2005

(51) Int. Cl.
*G08B 13/18* (2006.01)

(52) U.S. Cl. ..... 340/567; 340/541; 340/545.3

(58) Field of Classification Search ..... 340/541, 340/552, 553, 554, 555, 556, 565, 567, 545.3; 342/27, 28, 175; 343/700 MS, 866
See application file for complete search history.

(56) References Cited

U.S. PATENT DOCUMENTS

| | | | | |
|---|---|---|---|---|
| 4,654,622 | A * | 3/1987 | Foss et al. | 338/14 |
| 4,684,929 | A * | 8/1987 | Edwards et al. | 340/541 |
| 6,130,640 | A * | 10/2000 | Uematsu et al. | 342/175 |
| 6,204,762 | B1 | 3/2001 | Dering et al. | |
| 6,337,656 | B1 * | 1/2002 | Natsume et al. | 342/149 |
| 6,424,259 | B1 | 7/2002 | Gagnon | |
| 6,466,157 | B1 * | 10/2002 | Bjornholt et al. | 342/28 |
| 6,535,159 | B1 * | 3/2003 | Nishiguchi et al. | 342/27 |
| 6,667,724 | B1 * | 12/2003 | Barnes et al. | 343/893 |
| 6,922,145 | B1 * | 7/2005 | Piesinger | 340/541 |
| 6,950,021 | B1 * | 9/2005 | Butler | 340/545.3 |
| 2003/0160701 | A1 | 8/2003 | Akihiko et al. | |

FOREIGN PATENT DOCUMENTS

| | | |
|---|---|---|
| DE | 32 46 906 A1 | 6/1984 |
| DE | 298 21 468 U1 | 4/1999 |
| WO | WO 02/49427 A | 6/2002 |

OTHER PUBLICATIONS

Malibu Research, Flaps: Reflector Antennas.

* cited by examiner

*Primary Examiner*—Van T. Trieu
(74) *Attorney, Agent, or Firm*—Thomas J. Finn; Leonard A. Aikov; Kari A. Vick

(57) ABSTRACT

An area-protection system uses an active-array antenna to generate a high-power millimeter-wave wavefront to deter an intruder within a protected area. One or more reflectors may be positioned within the protected area to help retain energy of the wavefront within the area. The area-protection system may include an intrusion-detection subsystem to detect presence of the intruder within the protected area and to generate a detection signal. The active-array antenna may generate the high-power millimeter-wave wavefront in response to the detection signal. In some embodiments, the intrusion-detection subsystem may detect the presence of a tag worn by the intruder, and may instruct the array antenna to refrain from generating the wavefront when tag is authenticated. In some embodiments, an illuminator may be used detect intruder movement based on return signals. In some embodiments, the array antenna includes semiconductor wafers arranged together on a substantially flat surface.

29 Claims, 7 Drawing Sheets

MILLIMETER-WAVE AREA-PROTECTION SYSTEM AND METHOD

TECHNICAL FIELD

Embodiments of the present invention pertain to security systems, and in particular, to systems that inhibit intruders using RF energy.

BACKGROUND

Some conventional intrusion-deterring techniques rely on lethal force to deter an intruder. For example, armed guards including police officers carrying lethal weapons are typically used to protect a building or store, armored car, a location within a building or other location. Guards armed with non-lethal weapons are generally less effective in deterring intruders. One problem with the use of lethal weapons is that discipline and restraint must be exercised before their use to preserve valuable human life. This is sometimes difficult for even the most trained and experienced persons to exercise. The use of automated lethal force (e.g., without human control) is generally prohibited.

Conventional security systems, on the other hand, use locks, vaults or other mechanical devices to protect an item or an area and deter an intruder. Some conventional security systems may also employ electronic means to detect an intruder and notify authorities. Many of these conventional systems can be easily circumvented by intruders, and many times the intruder may make off with the goods before authorities can respond. Another problem with these conventional security systems is that they may generate false alarms causing an unnecessary waste of resources.

Thus, there are general needs for improved security systems and methods of deterring intruders from a protected area. There are also general needs for systems and methods that provide improved security. There are also needs for non-lethal systems and methods that provide security. There are also needs for area-protection systems and methods that can deter intruders with non-lethal force.

SUMMARY

An area-protection system uses an active-array antenna to generate a high-power millimeter-wave wavefront to deter an intruder within a protected area. One or more reflectors may be positioned within the protected area to help retain and/or concentrate energy of the wavefront within the area. In some embodiments, the one or more reflectors are positioned to increase an energy density of the wavefront at a predetermined location of the area. In some embodiments, the area-protection system may include an intrusion-detection subsystem to detect presence of the intruder within the protected area and to generate a detection signal. The active-array antenna may generate the high-power millimeter-wave wavefront in response to the detection signal. In some embodiments, the intrusion-detection subsystem may detect the presence of a tag worn by the intruder, and may instruct the array antenna to refrain from generating the wavefront when tag is authenticated. In some embodiments, an optical illuminator, a LASER illuminator, a sonic illuminator, an ultrasonic illuminator, or an RF/RADAR illuminator may be used detect intruder movement based on return signals. In some embodiments, the array antenna includes semiconductor wafers arranged together on a substantially flat surface. In some embodiments, each semiconductor wafer may include power amplifiers and a transmit antenna to reflect an incident lower-power wavefront and to generate the high-power wavefront, although the scope of the invention is not limited in this respect.

BRIEF DESCRIPTION OF THE DRAWINGS

The appended claims are directed to some of the various embodiments of the present invention. However, the detailed description presents a more complete understanding of embodiments of the present invention when considered in connection with the figures, wherein like reference numbers refer to similar items throughout the figures and:

DETAILED DESCRIPTION

The following description and the drawings illustrate specific embodiments of the invention sufficiently to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. The scope of embodiments of the invention encompasses the full ambit of the claims and all available equivalents of those claims.

Figure 1A:
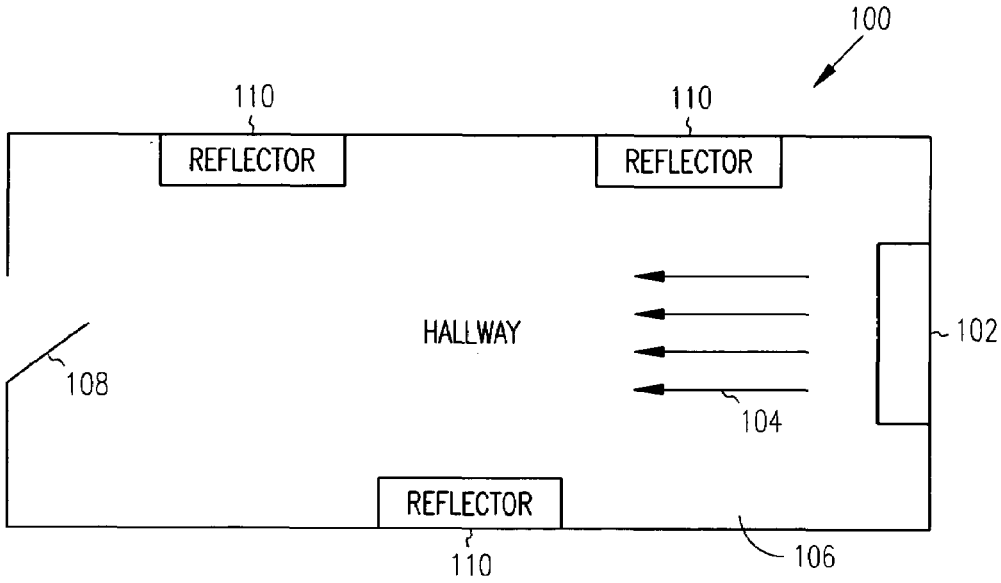
FIGS. 1A and 1B illustrate operational environments of area-protection systems in accordance with some embodiments of the present invention.

FIGS. 1A through 1D illustrate operational environments of area-protection systems in accordance with some embodiments of the present invention. FIG. 1A illustrates hallway-protection system 100 in which area-protection system 102 may direct high-power RF wavefront 104 within hallway 106 to deter or inhibit intruders. In these embodiments of the present invention, area-protection system 102 may detect an intruder and may responsively generate wavefront 104, or alternatively, area-protection system 102 may continually generate wavefront 104 within hallway 106. In some embodiments, the opening or jarring of a window or a door, such as door 108, may trigger or cause area-protection system 102 to generate wavefront 104. In some embodiments, system 104 may employ an intruder-detection subsystem to detect the presence of an intruder. This is described in more detail below. Wavefront 104 may increase the skin temperature of an intruder and may cause pain or even intense pain depending on the characteristics of wavefront 104.

In some embodiments, hallway protection system 100 may include one or more reflectors 110 which may be positioned to help direct and/or reflect wavefront 104 toward a particular location, such as door 108. Reflectors 110 may include almost any element that reflects RF energy, including metallic surfaces and mirrors. The particular type of reflectors selected for use in system 100 may depend on the specific frequency and characteristics of wavefront 104.

In embodiments, reflectors 110 may be used to control the volume of the emitted beam which may increase the power density of wavefront 104 in the area or location being protected. Furthermore, reflectors 110 may help reduce the amount of energy escaping the protected area helping to reduce effects of the energy on persons and equipment external to the protected area.

Although hallway protection system 100 is illustrated with area-protection system 102 located opposite door 108 in hallway 106, the scope of the present invention is not limited in this respect. In embodiments, area-protection system 102 may be located at almost any location depending on the characteristics of wavefront 104 and reflectors 110. For example, in some embodiments area-protection system 102 may be located on the ceiling, at an angle, behind wall panels, etc. Although hallway protection system 100 is illustrated with a single area-protection system 102, it should be understood that more than one area-protection system 102 may be included within system 100.

Figure 1B:
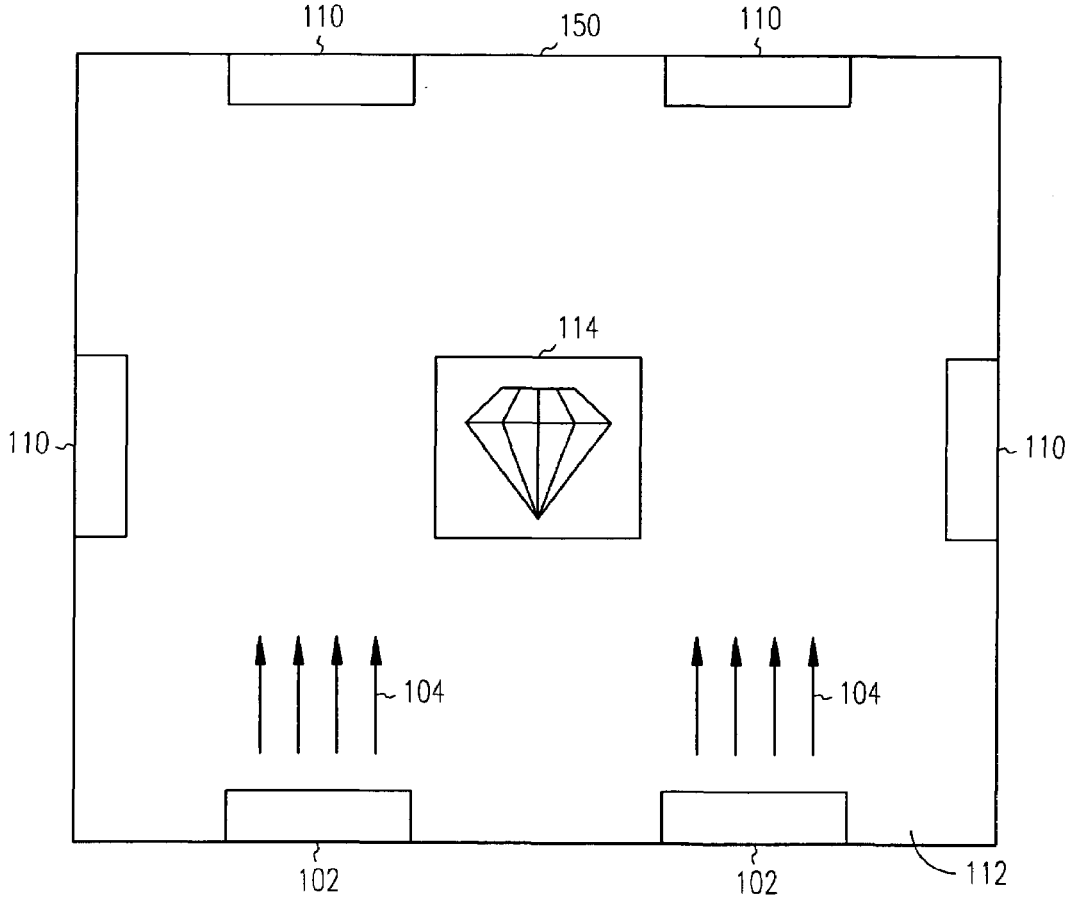

FIG. 1B illustrates environment 150 in which one or more area-protection system 102 may direct one or more high-power RF wavefronts 104 within area 112 to deter or inhibit intruders. In these embodiments, one or more reflectors 110 may be positioned at various locations within area 112 to direct energy from wavefronts 104 from one or more area-protection systems 102. In these embodiments, the energy may be directed at or toward specific locations within area 112 to inhibit intruders at those specific locations (e.g., doors, windows). Alternatively, the energy of wavefronts 104 may be directed to cover substantially the entire room or area. In some embodiments, the energy of wavefronts 104 may be directed to protect an item at one or more particular locations, such as location 114. In these embodiments, systems 102 may be used to guard a valuable item such as jewelry, weapons, or works or art, although the scope of the present invention is not limited in this respect. In some embodiments, an area, such a hallway 106 or area 112 may have a plurality of emitters (e.g., antennas for area-protection system 102 to provide a sufficient power density within the hallway or area.

Referring to both FIGS. 1A and 1B, in some embodiments, high-power wavefronts 104 may be a high-power collimated wavefronts in which the energy may be substantially provided in a cylindrical-type shape. In these embodiments, the energy may be substantially uniform for being directed down hallway 106. In other embodiments, high-power wavefront 104 may be a focused-controlled high-power wavefront, such as a high-power converging wavefront, in which the energy may substantially be provided in a converging shape. In these embodiments, the energy density may increase toward a location which may be at or near door 108 or location 114. The wavefront characteristics may depend on the particular antenna system selected for use by area-protection system 102. These embodiments are described in more detail below.

Wavefront 104 generated by area-protection system 102 may comprise an RF frequency selected specifically to deter an intruder. For example, a millimeter-wave frequency may be selected to increase the skin temperature of an intruder and inhibit the intruder from proceeding down hallway 106 or entering area 112. In embodiments, the frequency may be selected to increase a bond-resonance between the atoms of water molecules (e.g., the hydrogen-to-oxygen bonds), although the scope of the invention is not limited in this respect. Millimeter-wave frequencies (e.g., 30 to 300 GHz) may be suitable, and in some embodiments, W-band frequencies (e.g., 77 to 110 GHz) may be particularly suitable, although the scope of the invention is not limited in this respect. A millimeter-wave frequency may also be chosen so that heating occurs primarily within a predetermined surface depth of an intruder's skin. In embodiments, the skin-depth may, for example, be much less than a millimeter, although the scope of the invention is not limited in this respect.

Those of ordinary skill in the art may choose appropriate power levels and associated system components for providing high-power wavefront 104 depending on distance, temperature, and operational environment for which area-protection system 102 is used. In some embodiments, area-protection system 102 may be configured to generate a predetermined power density at a distance of up to several meters and greater.

In some embodiments, wavefront 104 may be a wavefront comprised of coherent RF energy to help reduce spreading, although the scope of the invention is not limited in this respect. In some embodiments, area-protection system 102 generates a pulsed high-power wavefront. In these embodiments, area-protection system 102 may change either a pulse-repetition-rate or a pulse-duration time of wavefront 104 to control the amount of energy directed at an intruder. In other embodiments, area-protection system 102 may generate a continuous-wave wavefront and the power level of the wavefront may be varied to control the amount of energy directed at an intruder. In some embodiments, area-protection system 102 may include a power-controlling subsystem to change the amount of energy in wavefront 104 based on the location of the intruder, the temperature of the intruder's skin, and/or the movement of the intruder. For example, area-protection system 102 may increase the energy level in wavefront 104 when the intruder is approaching, and decrease the energy level when the intruder is leaving. These embodiments are described in more detail below.

In some embodiments, area-protection system 102 may be disabled by an authorized party wearing a tag. In these embodiments, the presence of the tag may be sensed by area-protection system 102, and the party may be authorized by information on the tag. Accordingly, area-protection system 102 may refrain from generating wavefront 104 in response to the presence of an authorized party in hallway 106 or area 112 to permit the authorized party access.

In some embodiments, reflectors 110 may be controlled by area-protection system 102 to help focus or direct wavefront 104 at a particular location. In some embodiments, area-protection system 102 may have a beam director to direct to change the direction of wavefront 104 and may direct wavefront 104 at one or more reflectors 110 as well as one or more locations in hallway 106 or area 112.

In some embodiments, area-protection system 102 may be used to protect passages areas against unauthorized entry or intrusion. The use of area-protection system 102 may be safe for nearby people in case of accidental use, which is unlike lethal systems. In some embodiments, area-protection system 102 may be used to protect a cockpit of an aircraft.

Figure 1C:
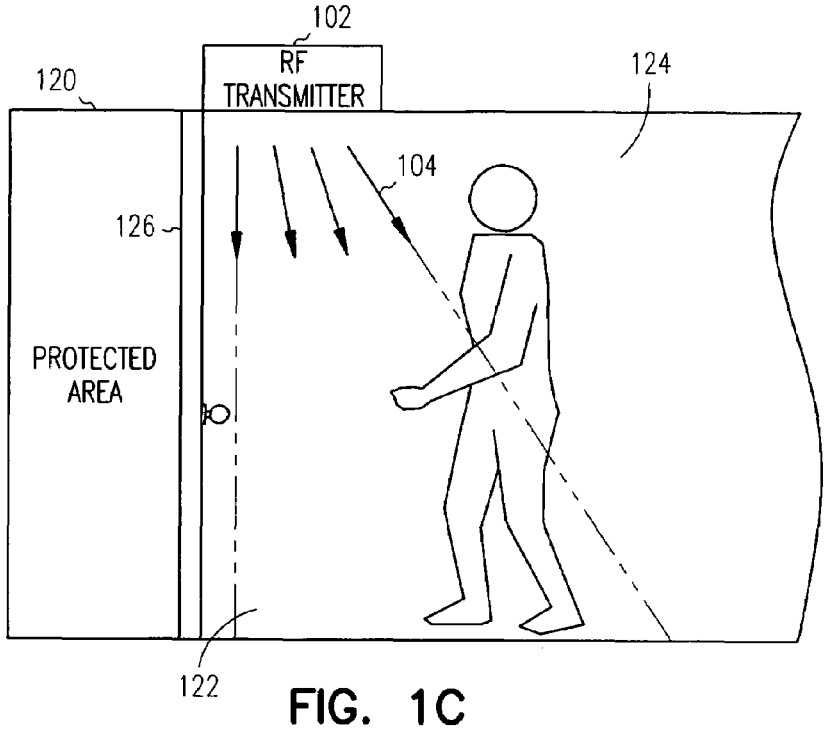
FIGS. 1C and 1D illustrate side and top views of an operational environment of an area-protection system in accordance with some embodiments of the present invention.
Figure 1D:
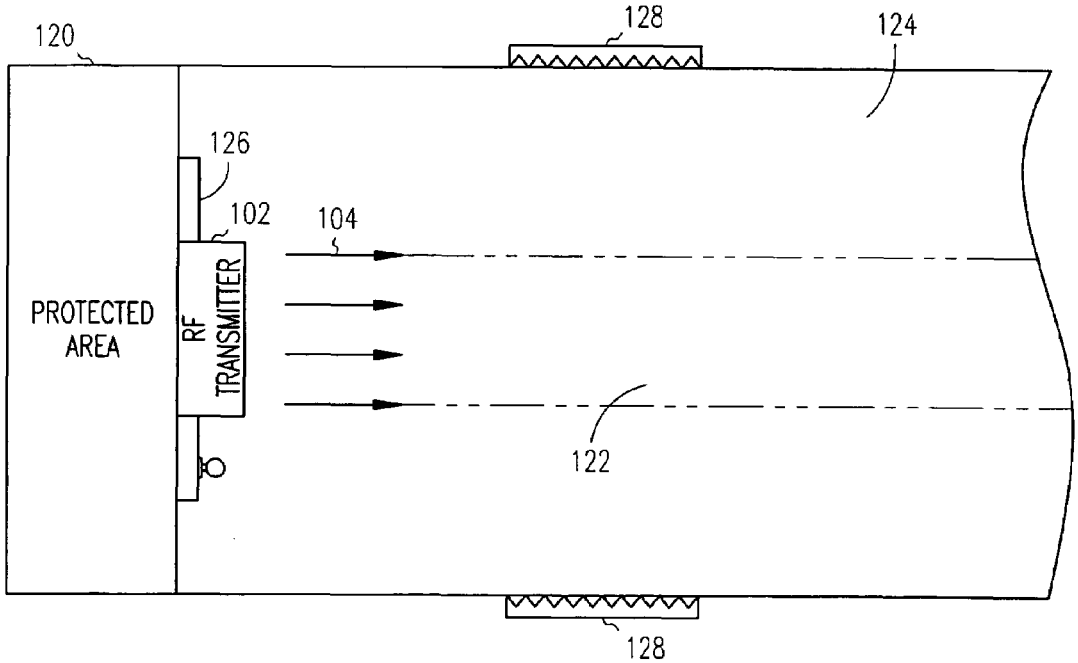

FIGS. 1C and 1D illustrate side and top views of an operational environment of an area-protection system in accordance with some embodiments of the present invention. In these embodiments, area-protection system 102 may inhibit an intruder from entering protected area 120 by generating wavefront 104 within region 122 of hallway 124. In these embodiments, a transmitter or antenna for generating the energy may be positioned above door 126 as illustrated, although this is not a requirement. In some embodiments, batters 128 may be used to reflect, shape and/or control the energy within region 122 to help maximize energy density. Batters 128 may include reflectors, mirrors and/or other passive elements.

Although the operational environments illustrated in FIGS. 1A through 1D show one or more area-protection systems 102 at various locations, it should be understood that it may be necessary to only locate the antenna or transmitting element of an area-protection system at the location indicated, as other system components may be located remotely.

Figure 2:
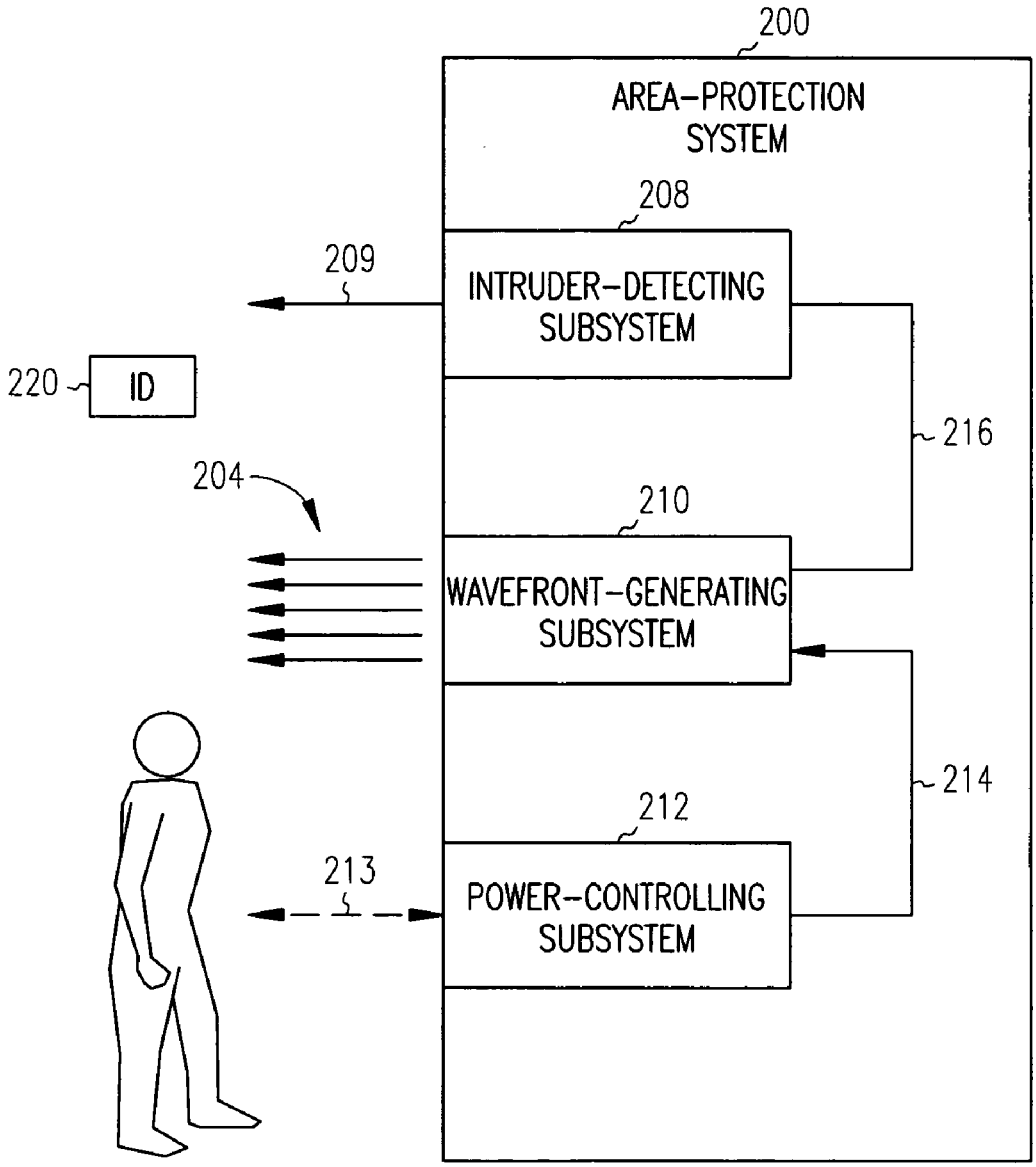
FIG. 2 illustrates a functional block diagram of an area-protection system in accordance with some embodiments of the present invention.

FIG. 2 illustrates a functional block diagram of an area-protection system in accordance with some embodiments of the present invention. Area-protection system 200 may be suitable for use as area-protection system 102 (FIGS. 1) although other systems may be suitable. Area-protection system 200 includes wavefront-generating subsystem 210 to generate high-power wavefront 204. In some embodiments, area-protection system 200 may also include intruder-detecting subsystem 208 to detect a presence of an intruder, and/or power-controlling subsystem 212 to control the amount of energy directed by wavefront 204.

In some embodiments, power-controlling subsystem 212 may measure a skin temperature of an intruder with thermal-sensing signal 213. Power-controlling subsystem 212 may generate temperature control signal 214 for wavefront-generating subsystem 210 as part of a feedback-loop to help maintain the temperature within or below a predetermined temperature or within a predetermined temperature range. For example, power-controlling subsystem 212 may help maintain temperature below a predetermined temperature, or within a predetermined temperature range. In some embodiments, subsystem 212 may be used to configure subsystem 210 to generate a lowest-power wavefront required to achieve the desired effect on an intruder. The power level of wavefront 204 may be selected to cause the intruder pain, and may be selected to cause mild pain or severe pain.

In some embodiments, wavefront-generating subsystem 210 may act as a warning device to indicate that an area should not be entered. In these embodiments, power levels of wavefront 204 may be reduced to less-than-painful levels, such as by changing duty-cycles to allow egress. A sidelobe power level that is graded in intensity may also be provided. The graded power levels may provide some discomfort and may cause an aversion effect before the intruder is in a more painful part of wavefront 204.

In some embodiments, intruder-detecting subsystem 208 may include an intruder tracker to track movement and/or location of an intruder and generate tracking-control signal 216. In some embodiments, wavefront-generating subsystem 210 may direct high-power wavefront 204 at or toward the tracked intruder in response to tracking-control signal 216. In some embodiments, intruder-detecting subsystem 208 may include a biometric identifier to determine whether the intruder is actually a biological entity (e.g., a human, animal, or other a living creature) or a non-biological entity (e.g., a non living thing like a rock, vehicle, or tank). In these embodiments, intruder-detecting subsystem 208 may generate tracking-control signal 216 when a biological entity is detected, and may refrain from generating tracking-control signal 216 and wavefront 204 when a biological entity is not detected.

In at least one embodiment, intruder-detecting subsystem 208 may track the movement or location of a detected intruder and generate control signal 216 for wavefront-generating subsystem 210. In these embodiments, wavefront-generating subsystem 210 may direct high-power wavefront 204 at the intruder in response to directional information provided in control signal 216.

In embodiments, intruder-detecting subsystem 208 may include an illuminator to detect a biological entity based on movement using motion-detection signal 209. The illuminator may be an active illuminator and may comprise an infrared (IR) sensor, a LASER sensor, an ultrasonic sensor, or a RF/RADAR system which transmits signals and detects movement based on returns or received signals. In other embodiments, intruder-detecting subsystem 208 may include a passive subsystem for detecting intruders and may include an optical or video sensor, an infrared (IR) sensor and/or a noise sensor to detect an intruder based on light, heat or sound. When signal 209 is a laser signal, subsystem 208 may direct and place a laser spot on an intruder and determine the distance to the intruder and/or to determine whether the intruder is moving toward or away from a protected area. The laser signal placed on the intruder may also be used to warn the intruder.

In some embodiments, area-protection system 200 may be disabled by an authorized party wearing tag 220. In these embodiments, the presence of tag 220 may be sensed by intruder-detecting subsystem 208, and the party may be authorized by identity (ID) information on the tag. Accordingly, wavefront-generating subsystem 210 may refrain from generating wavefront 204 in response to the presence of an authorized party. In some embodiments, tag 220 may comprise a transponder to identify the person to system 200. In some embodiments, tag 220 may be a passive RF tag, and intruder-detecting system 208 may be configured to read such tags. In other embodiments, tag 220 may be an active RF tag which may transmit an RF identification signal in response to an inquiry from subsystem 208.

In some embodiments, wavefront-generating subsystem 210 may perform at least some functions of intruder-detecting subsystem 208 and a separate intruder detecting system may not be required. In these embodiments, wavefront-generating subsystem 210 may include a receiver, and may detect intruders by transmitting a lower-power millimeter-wave signal. A detector within the receiver may look for indications of intrusions, such as a Doppler-shift or variation of intensity over time of returned signals. When an intruder is detected, subsystem 210 may responsively generate high-power wavefront 204. The Doppler-shift may also be used by subsystem 210 to determine whether the intruder is approaching or receding from a protected area and subsystem 210 may responsively change power and/or direction of wavefront 204.

In some embodiments, wavefront 204 may be multiplexed and sent in more than one direction at different times to provide coverage over a larger area. In some embodiments, area-protection system 200 may, in addition to serving as an area protection system, serve as an animal control system. In some embodiments, system 200 may be incorporated into a building's walls, hallways, ceilings and/or floors.

Although area-protection system 200 is illustrated with intruder-detecting subsystem 208 and power-controlling subsystem 212, either or both of these subsystems can be optional. For example, wavefront-generating subsystem 210 may be turned on and off manually, such as when a security guard spots an intruder. In some embodiments, wavefront 204 may be pulsed and the duration of the pulses may be changed depending on whether the intruder is approaching or receding from a protected location or area. In these embodiments, the power may be turned off for a short time to see if the intruder leaves. This may allow time for the intruder to leave.

Figure 3:
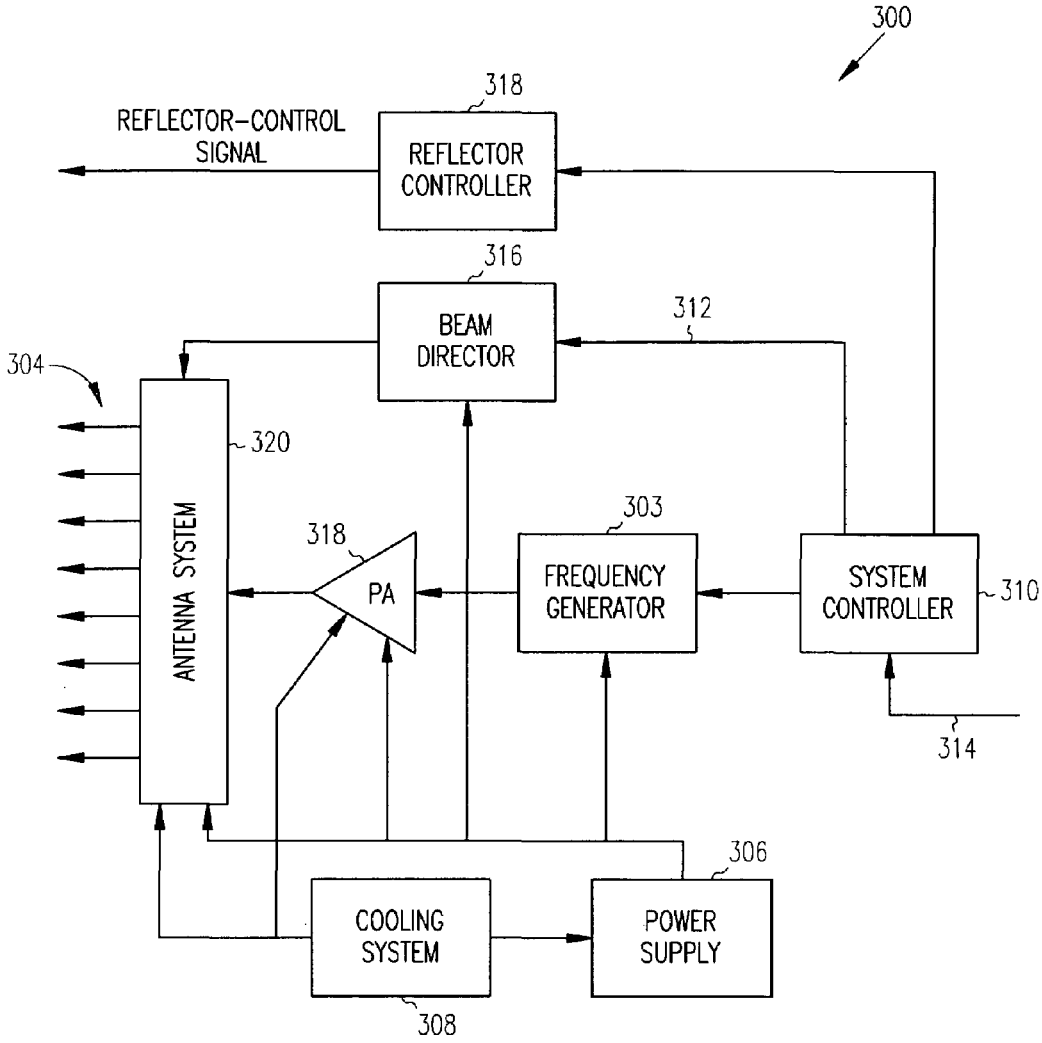
FIG. 3 is a functional block diagram of a wavefront-generating subsystem in accordance with some embodiments of the present invention.

FIG. 3 is a functional block diagram of a wavefront-generating subsystem in accordance with some embodiments of the present invention. Wavefront-generating subsystem 300 may be suitable for use as wavefront-generating subsystem 210 (FIG. 2), although other systems and subsystems may also be suitable. Wavefront-generating subsystem 300 includes antenna system 320 which generates high-power wavefront 304 at a millimeter-wave frequency. Wavefront-generating subsystem 300 may also comprise frequency generator 303 to generate the millimeter-wave frequency and power supply 306 to provide power for the various elements of subsystem 300. High-power wavefront 304 may be, for example, either in a collimated wavefront, a converging wavefront or a diverging wavefront.

In some embodiments, antenna system 320 may be a passive system which receives a high-power millimeter-wave frequency signal provided by frequency generator 303 and/or power amplifier 318. In these embodiments, frequency generator 303 and power amplifier 318 may comprise single or separate elements and may include a gyrotron, a traveling wave tube (TWT), and/or a klystron to generate a high-power millimeter-wave frequency signal for antenna system 320. In some embodiments, frequency generator 303 may generate a low-power millimeter-wave frequency signal, which may be amplified by power amplifier 318. In these embodiments, power amplifier 318 may comprise a high-power amplifier such as a traveling wave tube (TWT), or a klystron to generate the high-power millimeter-wave frequency signal for antenna system 320.

In other embodiments, antenna system 320 may be an active antenna system which receives a lower-power millimeter-wave frequency signal provided by frequency generator 303 and/or power amplifier 318. In these embodiments, frequency generator 303 and/or power amplifier 318 may comprise a crystal oscillator and/or semiconductor-based amplifier elements (e.g., transistor amplifiers) to generate the lower-power millimeter-wave frequency signal for antenna system 320. In these embodiments, antenna system 320 may amplify the lower-power millimeter-wave frequency signal to provide high-power wavefront 304.

Frequency generator 303 may utilize Gunn or Impatt diodes (e.g., on InP HEMP) to generate the millimeter-wave frequency signal, although other ways of generating and/or amplifying frequencies are also suitable. In some embodiments, power amplifier 318 is optional depending on the power level required by antenna system 320 and the power level provided by frequency generator 303.

Power supply 306 may include a low-voltage, high-current power supply capable of generating a high-surge current for antenna system 320. In these embodiments, power supply 306 may utilize large capacitors which can provide high-surge current as required by power amplifier 318, frequency generator 303 and/or antenna system 320.

Subsystem 300 may also include cooling subsystem 308 to reduce and/or control the temperature of elements of the subsystem, such as antenna system 320, frequency generator 303, power amplifier 318 and/or power supply 306. In some embodiments, cooling subsystem 308 may be a distributed system and may comprise one or more thermo-electric-cooling (TEC) elements, while in other embodiments cooling system 308 may incorporate a phase-change fluid, refrigerant, or coolant.

Subsystem 300 may also include system controller 310 which, among other things, may be responsive to signals 314 from other subsystems. For example, system controller 310 may receive temperature-control signal 214 (FIG. 2) from other subsystems, such as subsystem 212 (FIG. 2), and may respond accordingly.

In some embodiments, subsystem 300 may include beam director 316. System controller 310 may generate beam-forming control signals 312 to control beam director 316 to direct wavefront 304 in a particular direction, although the scope of the invention is not limited in this respect. In these embodiments, antenna system 320 may be capable of directing wavefront 304, and may comprise a phased-array type of antenna although the scope of the invention is not limited in this respect. The inclusion of beam director 316 in subsystem 300 may depend on the particular application for which subsystem 300 is intended, as well as the particular type of antenna system used for antenna system 320.

In some embodiments antenna system 320 may emit wavefront 304 comprised of either single frequencies, different frequencies or broadband frequencies. In these embodiments, the use of multiple frequencies emitted together or at different times may be used to achieve a desired temperature profile as a function of time on an intruder.

Those of ordinary skill in the art may choose appropriate power levels and associated system components for providing high-power wavefront 304 depending on distance and/or temperature requirements of subsystem 300. In some embodiments, subsystem 300 may generate a predetermined power density at a distance of up to several meters and greater. In some embodiments, wavefront 304 may be a wavefront comprised of coherent RF energy to help reduce spreading, although the scope of the invention is not limited in this respect.

In some embodiments, subsystem 300 may include reflector controller 318 which may actively control one or more reflectors, such as reflectors 110 (FIG. 1). In these embodiments, system controller 310 may control the reflectors based on intruder location information provided by intruder-detecting subsystem 208 (FIG. 2) to direct energy toward an intruder.

Although system 200 (FIG. 2) and subsystem 300 are illustrated as having several separate functional elements, one or more of the functional elements may be combined and may be implemented by combinations of software-configured elements, such as processing elements including digital signal processors (DSPs), and/or other hardware elements. For example, some elements may comprise one or more microprocessors, DSPs, application specific integrated circuits (ASICs), and combinations of various hardware and logic circuitry for performing at least the functions described herein.

Figure 4:
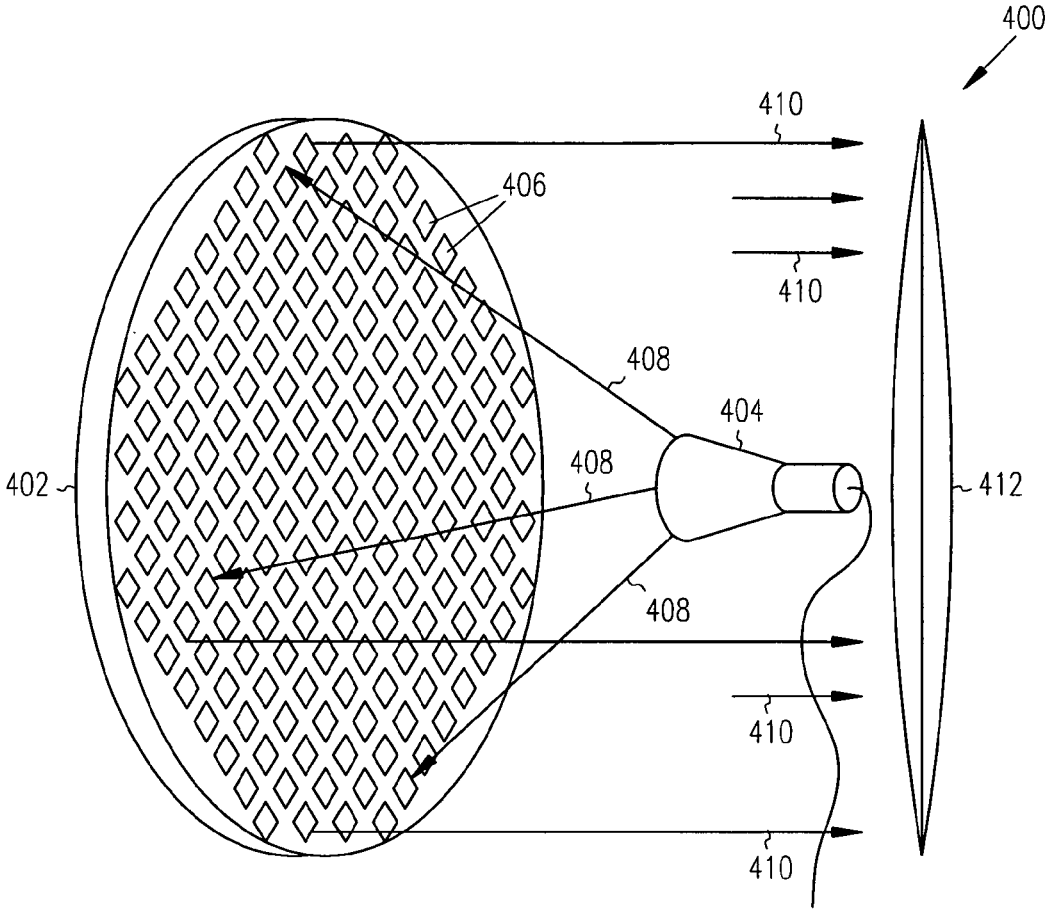
FIG. 4 illustrates an active-array antenna system in accordance with some embodiments of the present invention.

FIG. 4 illustrates an active-array antenna system in accordance with some embodiments of the present invention. Active-array antenna system 400 generates a high-power wavefront at a millimeter-wave frequency and may be suitable for use as antenna system 320 (FIG. 3) although other antennas and antenna systems may also be suitable. Active-array antenna system 400 may be concealed in walls, ceilings, floors, above doorways, etc. as part of an area protection system. Active-array antenna system 400 may receive a lower-power millimeter-wave frequency signal from frequency generator 303 (FIG. 3) and/or power amplifier 318 (FIG. 3) for use in generating high-power wavefront 304 (FIG. 3).

In these embodiments, active-antenna system 400 includes active reflect-array 402 which may be spatially fed by low-power feed 404. Active reflect-array 402 may comprise a plurality of semiconductor wafers 406 (e.g., monolithic substrates) arranged or tiled together. In the illustrated embodiments, wafers 406 may be tiled together in a substantially parabolic shape, although the scope of the invention is not limited in this respect. Low-power feed 404 may provide lower-power wavefront 408 at a millimeter-wave frequency for incident on active reflect-array 402. Wavefront 408 may be a substantially vertically-polarized wavefront, although this is not a requirement. In response to wavefront 408, active reflect-array 402 may generate high-power wavefront 410.

In embodiments, active reflect-array 402 may include a plurality of receive antennas to receive wavefront 408 from low-power feed 404, and may include a plurality of power amplifiers to amplify signals of the wavefront received by an associated one of the receive antennas. Active reflect-array 402 may also include a plurality of transmit antennas to transmit the amplified signals to provide high-power wavefront 410.

In embodiments, low-power feed 404 be a passive feed, such as a directional antenna, to provide wavefront 408 for incidence on active reflect-array 402. In other embodiments, feed 404 may comprise a passive reflector to reflect a millimeter-wave frequency and provide wavefront 408 for incidence on active reflect-array 402. In these embodiments, feed 404 may reflect a millimeter-wave signal transmitted by a feed which may be near the center of array 402, although the scope of the invention is not limited in this respect.

In some other embodiments, low-power feed 404 may be an active feed to coherently amplify and reflect a millimeter-wave frequency received from a source within (e.g., at or near the center) active reflect-array 402, although the scope of the invention is not limited in this respect. In these embodiments, low-power feed 404 may comprise one or more receive antennas to receive the millimeter-wave frequency from the feed source, one or more amplifiers to amplify the received millimeter-wave frequency, and one or more transmit antennas to transmit the amplified signals and provide lower-power wavefront 408 for incidence on active reflect-array 402.

In yet other embodiments, low-power feed 404 may receive a signal from a signal source for transmission such frequency generator 303 (FIG. 3) and/or power amplifier 318 (FIG. 3). Alternatively, low-power feed 404 may include a frequency generator and a power amplifier, such frequency generator 303 (FIG. 3) and/or power amplifier 318 (FIG. 3), to generate the millimeter-wave frequency and generate wavefront 408.

Depending on the shape of active reflect-array 402, and the phasing, polarization and/or coherency of wavefront 408, (among other things), active reflect-array 402 may be configured to generate either a high-power collimated wavefront, or a high-power converging or diverging wavefront. In some embodiments, beamforming element 412 may be used to collimate, converge or diverge wavefront 410 depending on the desired outcome and the type of wavefront generated by array 402. In some embodiments, beamforming element 412 may be an RF lens or a Fresnel type lens, although the scope of the invention is not limited in this respect.

In other embodiments, low-power feed 404 may be a passive source. In these embodiments, feed 404 may be implemented as a passive partly-reflecting plate element to provide a wavefront emission (e.g., wavefront 408) to reflect array 402. In these embodiments, the wavefront emission may actually be part of the wavefront emission (e.g., wavefront 410) that is reflected back. In these embodiments, millimeter-wave frequencies may be generated with the natural and/or induced oscillations of individual semiconductor wafers 406 of a passive reflect array in place of active reflect-array 402. In one embodiment, a passive low power feed (e.g., feed 404) may be used together with a beamforming element in the path of wavefront 408 to reflect into a partly reflecting single plate element. In these embodiments, the spacing between monolithic array 402 and the partly reflecting element resulting from the combination of passive source 404 and beam forming element 412 may control the final output frequency radiated as wavefront 410. In these embodiments, active-array system 400 may have its output radiative emission generated without the necessity of other low-level sources, such as frequency generator 303 (FIG. 3). In these embodiments, the shape of the combined partly reflecting elements (e.g., 404 and 412) may control the phase of the individual semiconductor wafers 406 to allow the final beam (e.g., wavefront 410) to have a desired phase front. Control of phase constants between elements of the active reflect-array 402 or by physically or electrically shifting the low-power feed element may provide for more optimal distributions or direction-steering capabilities of wavefront 410.

Figure 5:
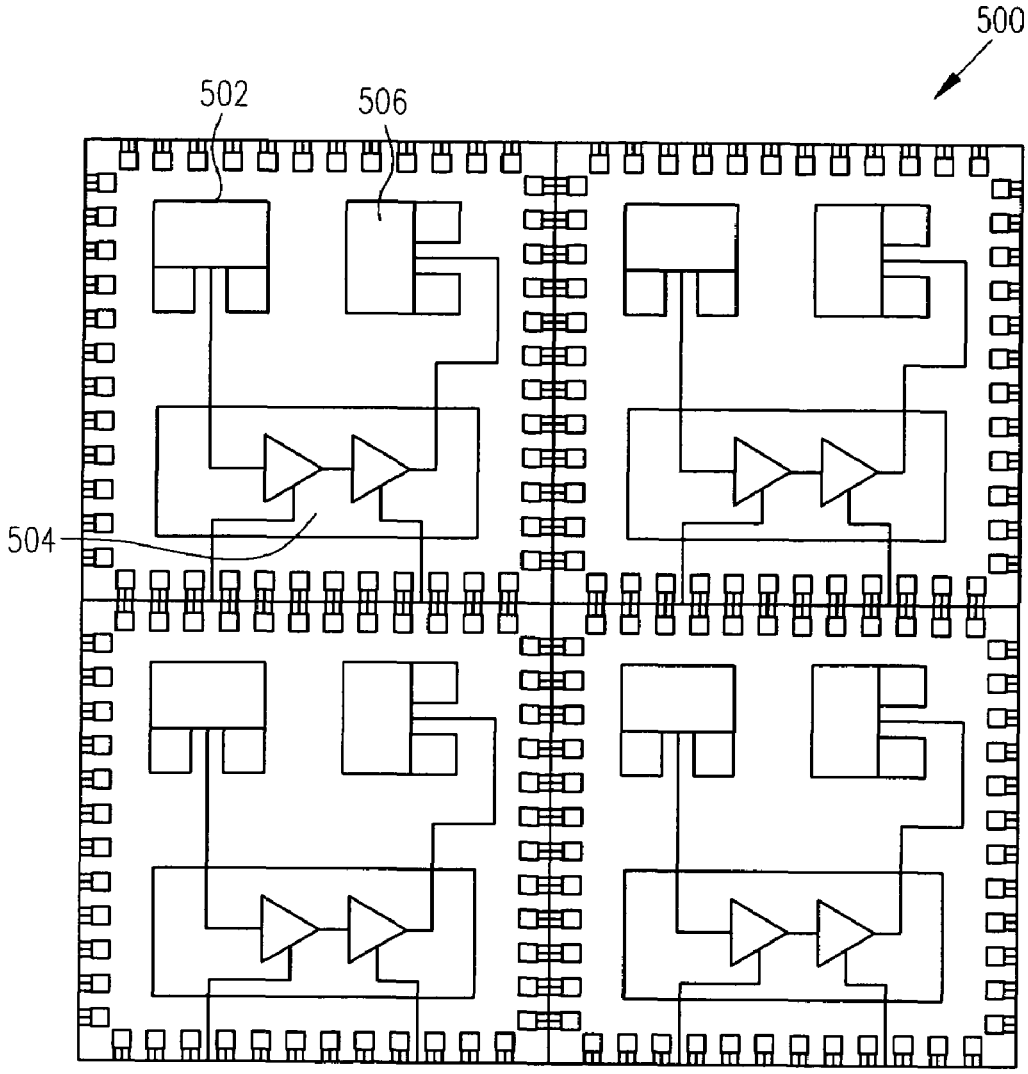
FIG. 5 illustrates a portion of a semiconductor wafer suitable for use as part of an active reflect-array in accordance with some embodiments of the present invention.

FIG. 5 illustrates a portion of a semiconductor wafer suitable for use as part of an active reflect-array, such as active reflect-array 402 (FIG. 4) in accordance with some embodiments of the present invention. Portion 500 may be suitable for wafers 406 (FIG. 4) although other semiconductor wafers may also be suitable. Semiconductor wafer portion 500 may include one or more receive antennas 502 to receive a wavefront, such as wavefront 408 (FIG. 4) which may be a substantially vertically-polarized wavefront. Portion 500 may also include one or more sets of power amplifiers 504 to amplify signals of the wavefront received by an associated one of receive antennas 502. Portion 500 may also include one or more transmit antennas 506 to transmit the amplified signals to generate a high-power wavefront, such as wavefront 410 (FIG. 4) at a millimeter-wave frequency. In embodiments, each set of power amplifiers 504 may be associated with one of the transmit and one of the receive antennas. In some embodiments, portion 500 may include separate receive and transmit antennas, while in other embodiments, amplification elements may utilize a single antenna for receiving and transmitting.

In embodiments, antennas 502 and 506 may be patch antennas; however other antennas such as a dipole antenna, a monopole antenna, a loop antenna, a microstrip antenna or other type of antenna suitable for reception and/or transmission of millimeter-wave signals may also be suitable. In one embodiment, a dual-polarized patch antenna may be used for both transmit and receive functions.

Examples of active-reflect array antennas which may be suitable for use as active-array antenna system 400 (FIG. 4) and semiconductor wafer portion 500 are described in U.S. patent application Ser. No. 10/153,140, entitled "MONOLITHIC MILLIMETER-WAVE REFLECT ARRAY SYSTEM", having a file date of May 30, 3002, and assigned to same assignee as the present invention. The U.S. Patent Application is hereby incorporated by reference.

Figure 6:
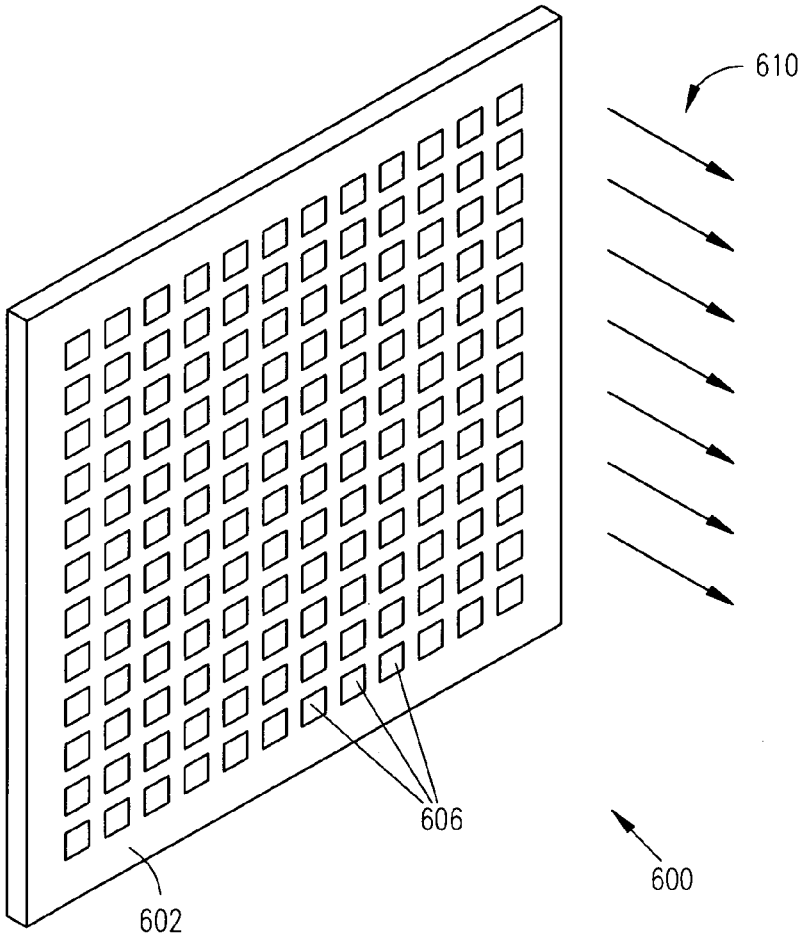
FIG. 6 illustrates a planar active-array antenna system in accordance with some embodiments of the present invention.

FIG. 6 illustrates a planar active-array antenna system in accordance with some embodiments of the present invention. Active-array antenna system 600 generates high-power wavefront 610 at a millimeter-wave frequency and may be suitable for use as antenna system 320 (FIG. 3) although other antennas may also be suitable. Active-array antenna system 600 may be concealed in walls, ceilings, floors, above doorways, etc. as part of an area protection system. Active-array antenna system 600 may receive a lower-power millimeter-wave frequency signal from frequency generator 303 (FIG. 3) and/or power amplifier 318 (FIG. 3) for use in generating high-power wavefront 610.

In some embodiments, antenna system 600 may include substantially flat structural element 602 having a plurality of semiconductor wafers 606 (e.g., monolithic substrates) arranged therein or tiled together in a substantially flat shape. Each of semiconductor wafers 606 may comprise one or more sets of power amplifiers to amplify the millimeter-wave frequency, and one or more transmit antennas to generate high-power wavefront 610 at the millimeter-wave frequency. Each set of power amplifiers may be associated with one of the transmit antennas. In these embodiments, wafers 606 of planar active-array antenna system 600 may be fed with one or more millimeter-wave signals from a signal source (not shown) for amplification and transmission. In some embodiments, array antenna system 600 may comprise a single monolithic semiconductor substrate, rather than many wafers 606 tiled together.

Active-array antenna system 600 may be configured to generate either a high-power collimated wavefront, or a high-power converging or diverging wavefront depending on factors such as coherency, phasing and/or polarization. In some embodiments, a separate beamforming element may be used to collimate, converge or diverge wavefront 610 depending on the desired outcome and the type of wavefront desired to be generated by antenna system 600. In some embodiments, the additional beamforming element may be an RF lens, although the scope of the invention is not limited in this respect. In some embodiments, the direction of wavefront 610 may be controlled by a beam director, such as beam director 316 (FIG. 3).

Figure 7:
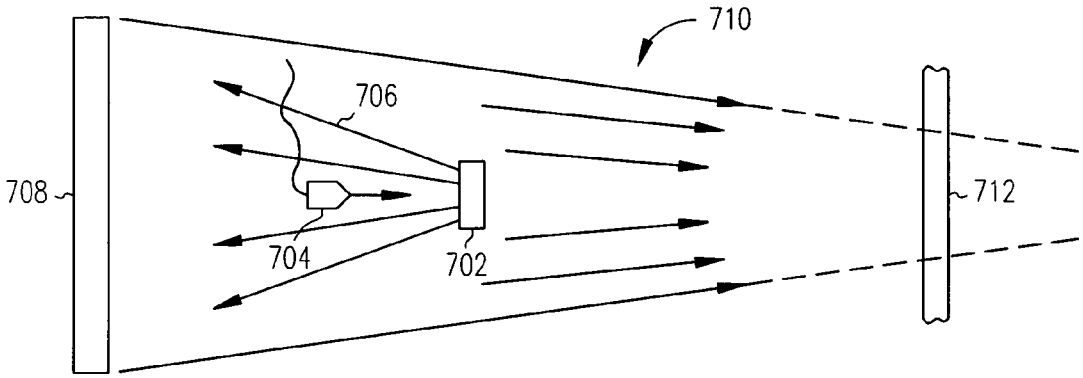
FIG. 7 illustrates a side view of a passive reflect-array antenna system in accordance with some other embodiments of the present invention.

FIG. 7 illustrates a side view of a passive reflect-array antenna system in accordance with some other embodiments of the present invention. Passive reflect-array antenna system 700 generates high-power wavefront 710 at a millimeter-wave frequency and may be suitable for use as antenna system 320 (FIG. 3) although other antennas may also be suitable. Passive reflect-array antenna system 700 may be concealed in or behind walls, ceilings, floors, above doorways, etc. as part of an area protection system. Passive reflect-array antenna system 700 may receive a high-power millimeter-wave frequency signal from frequency generator 303 (FIG. 3) and/or power amplifier 318 (FIG. 3) for use in generating high-power wavefront 710.

Antenna system 700 includes passive reflector 702 which may reflect a millimeter-wave frequency signal received from signal source 704. Reflector 702 may provide wavefront 706 for incidence on passive reflect antenna 708. Wavefront 706 may be a high-power vertically-polarized wavefront and reflector 702 may be a substantially flat circular metallic element. Passive reflect antenna 708 may be spatially fed and may include a plurality of antennas to receive wavefront 706 and provide high-power wavefront 710. In some embodiments, high-power wavefront 710 may be a converging (or diverging) wavefront which may converge (or diverge) at or near surface 712. In some other embodiments, high-power wavefront 710 may be a collimated wavefront. In embodiments in which a high-power converging-conical wavefront is generated, the spacing between reflector 702 and reflect antenna 708 may be changed to change the convergence point of the wavefront 710.

Passive reflect antenna 708 may have a flat or parabolic shape and may comprise a plurality of individual antenna elements, such as dual-polarized dipoles of differing sizes, arranged circumferentially around a center point. In these embodiments, each antenna element may receive and transmit and may provide approximately a 180 degree phase shift, although the scope of the invention is not limited in this respect. The antenna elements may have varying sizes and shapes to receive wavefront 706 and generate wavefront 710. An example of one type of antenna suitable for use as passive reflect antenna 708 is the flat parabolic surface reflector antenna by Malibu Research of Calabasas, Calif., although other passive reflect antennas may also be suitable. Although reflector 702 and feed 704 are illustrated as being located or positioned within wavefront 710, reflector 702 and feed 704 may actually be positioned below or to the side so as to at least partially avoid wavefront 710.

In some embodiments, reflector 702, feed 704, reflect antenna 708 and other system components may be mounted or located on a tripod or other transportable device. These embodiments, along with the changing of the focus distance, may allow wavefront 710 to be directed and focused at almost any surface or any thing to protect an area.

In some embodiments, reflector 702 and source 704 of the low-power feed network may be removed, and surface 712 may be reflective or may include a reflective plate. In these embodiments, a cavity may be formed between a plate of antenna 708 and the plate in surface 712 to reflect energy therebetween. As a result of these reflections, the radiative emissions of antenna 708 may become coherent due to the reflected energy causing the monolithic amplifiers to phase lock. The relative phase of the amplifiers of antenna 708 may be controlled to allow for beam steering, among other things.

It is emphasized that the Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features are occasionally grouped together in a single embodiment for the purpose of streamlining the disclosure. This method of disclosure is not to be interpreted as reflecting an intention that the claimed embodiments of the subject matter require more features that are expressly recited in each claim. Rather, as the following claims reflect, inventive subject matter lies in less than all features of a single disclosed embodiment. Thus the following claims are hereby incorporated into the detailed description, with each claim standing on its own as a separate preferred embodiment.

What is claimed is:

1. An area-protection system comprising:

sensors to detect an intruder within a protected area;

an active-array antenna to generate a high-power millimeter-wave wavefront to deter the intruder when detected within the protected area; and one or more reflectors positioned within the protected area to help retain energy of the wavefront within the area, wherein the active-array antenna comprises a plurality of semiconductor wafers arrnged together on a substantially flat surface, each semiconductor wafer including a power amplifier and a transmit antenna which together generate the high-power millimeter-wave wavefront.

2. The system of claim 1 wherein the one or more reflectors are positioned to increase an energy density of the wavefront in a predetermined location of the protected area.

3. The system of claim 1 wherein the high-power millimeter-wave wavefront generated by the plurality of semiconductor wafers is a coherent wavefront.

4. An area-protection system comprising:

an active-array antenna to generate a high-power millimeter-wave wavefront to deter an intruder within a protected area;

one or more reflectors positioned within the protected area to help retain energy of the wavefront within the area; and an intrusion-detection subsystem to detect a presence of the intruder within the protected area and generate a detection signal for the active-array antenna, wherein the active-array antenna is to generate the high-power millimeter-wave wavefront in response to the detection signal, and wherein the high-power wavefront is to increase a skin temperature of the intruder to deter the intruder.

5. The system of claim 4 wherein the intrusion-detection subsystem is to detect the presence of a tag worn by the intruder and is to instruct the active-array antenna to refrain from generating the wavefront when the tag is authenticated.

6. The system of claim 4 wherein the intrusion-detection subsystem includes an illuminator comprising one of an optical illuminator, a LASER illuminator, a sonic illuminator, an ultrasonic illuminator, or an RF/RADAR illuminator to transmit signals and detect intruder movement based on return signals.

7. An area-protection system comprising:

an intrusion-detection subsystem to detect presence of an intruder; and an intrusion-inhibiting subsystem comprising an active-array antenna to provide a high-power millimeter-wave wavefront in response to the detection of the intruder, the high-power millimeter-wave wavefront to deter the intruder, wherein the active-array antenna comprises a plurality of semiconductor wafers arranged together on a surface, each semiconductor wafer including a power amplifier and a transmit antenna which together generate the high-power millimeter-wave wavefront.

8. The system of claim 7 wherein the intrusion-detection subsystem includes an intruder tracker to track movement of the intruder and to generate a tracking-control signal for the array antenna, and wherein the intrusion-inhibiting subsystem further comprises a beam director to configure the array antenna to direct the high-power millimeter-wave wavefront toward the intruder to deter the intruder in response to the tracking-control signal.

9. The system of claim 7 wherein the intrusion-detection subsystem includes an illuminator to detect the intruder based on movement, and wherein the illuminator is an active illuminator comprising one of an optical illuminator, a LASER illuminator, a sonic illuminator, an ultrasonic illuminator, or an RADAR illuminator which transmits signals and detects intruder movement based on return signals.

10. The system of claim 7 wherein the intrusion-detection subsystem comprises a passive detection subsystem comprising one of an infrared (IR) sensor, an optical sensor, a sonic sensor or an ultrasonic sensor to detect the presence of the intruder.

11. The system of claim 7 wherein the high-power millimeter-wave wavefront generated by the plurality of semiconductor wafers is a coherent wavefront.

12. The system of claim 7 wherein the active-array antenna is to receive a spatially-fed millimeter-wave lower-power wavefront and is to amplify the lower-power wavefront to generate the high-power wavefront, wherein each semiconductor wafer further includes a receive antenna to receive millimeter-wave signals of the spatially-fed millimeter-wave lower-power wavefront for subsequent amplification by the power amplifier and transmission by the transmit antenna of an associated semiconductor wafer.

13. The system of claim 12 wherein the active-array antenna further comprises a passive reflector to reflect a millimeter-wave frequency signal from a feed and provide the lower-power wavefront for incident on an active reflect-array comprising the plurality of semiconductor wafers, wherein the plurality of semiconductor wafers is arranged on an at least partially parabolic surface, and wherein the receive and transmit antennas have orthogonal polarizations.

14. The system of claim 7 wherein the plurality of semiconductor wafers is arranged on a substantially flat surface.

15. An area-protection system comprising:

an intrusion-detection subsystem to detect presence of an intruder; and an intrusion-inhibiting subsystem comprising one of either an active-array antenna or a passive reflect-array antenna to provide a high-power millimeter-wave wavefront in response to the detection of the intruder to deter the intruder, wherein the high-power wavefront increases a skin temperature of the intruder, and wherein the system further comprises a thermal-sensing subsystem to measure the skin temperature and to generate a control signal for the intrusion-inhibiting subsystem to maintain the skin temperature either within a predetermined temperature range or below a predetermined temperature.

16. The system of claim 15 wherein when the system includes the active-array antenna, the active-array antenna to generates a continuous-wave wavefront, and wherein the intrusion-inhibiting subsystem further comprises a system controller to reduce a transmit power level of the wavefront in response to the control signal from the thermal- sensing subsystem to maintain the skin temperature either within the predetermined temperature range or below the predetermined temperature.

17. The system of claim 16 wherein the system controller reduces one of either a pulse-repetition-rate or a pulse-duration time of the wavefront in response to the control signal to maintain the skin temperature either within the predetermined temperature range or below the predetermined temperature.

18. An area-protection system comprising:

an intrusion-detection subsystem to detect presence of an intruder; and an intrusion-inhibiting subsystem comprising one of either an active-array antenna or a passive reflect-array antenna to provide a high-power millimeter-wave wavefront in response to the detection of the intruder to deter the intruder, wherein the intrusion-detection subsystem includes a biometric lock to determine whether the intruder is one or either a biological entity or a non-biological entity, the intrusion-detection subsystem to generate a biological-identification signal when a biological entity is detected, wherein the intrusion-inhibiting subsystem generates the high-power wavefront in response to the biological-identification signal, and wherein the intrusion-inhibiting subsystem refrains from generating the high-power wavefront when a non-biological entity is detected.

19. The system of claim 18 wherein the intrusion-detection subsystem further comprises a biometric tracker to further track movement of a detected biological entity and to generate a biological-entity tracking-control signal for the intrusion-inhibiting subsystem, the intrusion-inhibiting subsystem to direct the wavefront toward the biological entity in response to the biological-entity tracking-control signal.

20. An area-protection system comprising:

an intrusion-detection subsystem to detect presence of an intruder; and an intrusion-inhibiting subsystem comprising a passive reflect-array antenna to provide a high-power millimeter-wave wavefront in response to the detection of the intruder to deter the intruder, wherein the passive reflect-array antenna comprises a plurality of semiconductor wafers arranged on an at least partially parabolic surface to reflect a spatially-fed incident millimeter-wave signal to generate the high-power millimeter-wave wavefront, wherein each semiconductor wave comprises a receive antenna coupled to a transmit antenna to respectively receive and retransmit the spatially-fed incident millimeter-wave signals, and wherein the receive and transmit antennas have orthogonal polarizations.

21. An area-protection system comprising:

an intrusion-detection subsystem to detect presence of an intruder; and an intrusion-inhibiting subsystem comprising one of either an active-array antenna or a passive reflect-array antenna to provide a high-power millimeter-wave wavefront in response to the detection of the intruder to deter the intruder, wherein the intrusion-detection subsystem is to detect the presence of a tag worn by the intruder, wherein the intrusion-detection subsystem instructs the intrusion-inhibiting subsystem to refrain from generating the wavefront when the tag is authenticated by the intrusion-detection subsystem.

22. A method of protecting an area comprising:

detecting a presence of an intruder; and generating a high-power millimeter-wave wavefront with one of either an active-array antenna or a passive reflect-array antenna in response to the detection of the intruder to deter the intruder, wherein when the generating is performed with an active-array antenna, the method comprises generating the wavefront with a plurality of semiconductor wafers arranged together on a surface, each semiconductor wafer including a power amplifier and a transmit antenna which together generate the high-power millimeter-wave wavefront, and wherein when the generating is performed with a passive reflect-array antenna, the method comprises generating the wavefront with a plurality of passive antenna elements by receiving and retransmitting an incident millimeter-wave signal.

23. The method of claim 22 further comprising:

tracking movement of the intruder and to generate a tracking-control signal for the array antenna; and configuring the array antenna to direct the wavefront toward the intruder in response to the tracking-control signal.

24. The method of claim 22 wherein detecting comprises illuminating an area with an active illuminator comprising one of an optical illuminator, a LASER illuminator, a sonic illuminator, an ultrasonic illuminator, or an RF/RADAR illuminator which transmits signals to detect the intruder based on return signals.

25. The method of claim 22 wherein the passive reflect-array antenna comprises a plurality of passive semiconductor wafers arranged together, each passive semiconductor wafer comprising a receive antenna coupled with a transmit antenna, the receive antennas to receive a spatially fed incident millimeter-wave signal for retransmission by the transmit antennas to provide the high-power millimeter-wave wavefront.

26. A method of protecting an area comprising:

detecting a presence of an intruder;

generating a high-power millimeter-wave wavefront with one of either an active-aray antenna or a passive reflect-aray antenna in response to the detection of the intruder to deter the intruder;

increasing a skin temperature of the intruder with the high-power millimeter-wave wavefront;

measuring the skin temperature; and generating a control signal to maintain the skin temperature either within a predetermined temperature range or below a predetermined temperature.

27. The method of claim 26 further comprising reducing a transmit power level of the wavefront in response to the control signal to maintain the skin temperature either within the predetermined temperature range or below the predetermined temperature.

28. The method of claim 26 further comprising reducing one of either a pulse-repetition-rate or a pulse-duration time of the wavefront in response to the control signal to maintain the skin temperature either within the predetermined temperature range or below the predetermined temperature.

29. A method of protecting an area comprising:

detecting a presence of an intruder;

generating a high-power millimeter-wave wavefront with one of either an active-array antenna or a passive reflect-array antenna in response to the detection of the intruder to deter the intruder;

detecting a presence of a tag worn by the intruder;

authenticating the tag; and refraining from generating the wave front when tag is authenticated.

* * * * *